US005491298A

United States Patent [19]

Eiichiro

[11] Patent Number: 5,491,298

[45] Date of Patent: Feb. 13, 1996

[54] AUTOMATIC ACCOMPANIMENT APPARATUS DETERMINING AN INVERSION TYPE CHORD BASED ON A REFERENCE PART SOUND

[75] Inventor: Aoki Eiichiro, Shizuoka, Japan

[73] Assignee: Yamaha Corporation, Hamamatsu, Japan

[21] Appl. No.: 400,461

[22] Filed: Mar. 7, 1995

Related U.S. Application Data

[63] Continuation of Ser. No. 88,783, Jul. 8, 1993, abandoned.

[30] Foreign Application Priority Data

Jul. 9, 1992 [JP] Japan ..... 4-182183

[51] Int. Cl.[6] ..... G10H 1/22; G10H 1/38

[52] U.S. Cl. ..... 84/656; 84/669; 84/DIG. 2; 84/DIG. 22

[58] Field of Search ..... 84/613, 618, 637, 84/656, 669, 684, 715, DIG. 2, DIG. 22

[56] References Cited

U.S. PATENT DOCUMENTS 5,218,157 6/1993 Akagawa et al. ..... 84/DIG. 22

5,235,126 8/1993 Bruti et al. ..... 84/637 X

FOREIGN PATENT DOCUMENTS 4133096 5/1992 Japan .

*Primary Examiner*—Stanley J. Witkowski

*Attorney, Agent, or Firm*—Loeb and Loeb

[57] ABSTRACT

An automatic accompaniment apparatus which performs automatic accompaniment with a natural sounding advancement of chords. In the automatic accompaniment apparatus, one of component sounds of a chord which has a particular position in the order of the pitch is set as a reference part sound. The inversion type of chord is determined from the reference part sound, and then sounds of the chord are produced in accordance with the inversion type thus determined. The apparatus determines, as production of sounds of chords proceeds, a reference part sound of a present chord in accordance with a musical interval relationship of component sounds of the present chord to another reference part sound of a preceding chord and in accordance with a preset rule. The inversion type of the present chord is determined by the reference part sound.

15 Claims, 7 Drawing Sheets

ACCOMPANIMENT TIMING PATTERN

AUTOMATIC ACCOMPANIMENT APPARATUS DETERMINING AN INVERSION TYPE CHORD BASED ON A REFERENCE PART SOUND

This is a continuation of application Ser. No. 08/088,783 filed Jul. 8, 1993, now abandoned.

BACKGROUND OF THE INVENTION

1. Field of the Invention

This invention relates to an automatic accompaniment apparatus for an electronic musical instrument or a like instrument which produces predetermined chord component sounds in accordance with advancement of chords to perform automatic accompaniment.

2. Description of the Related Art

Conventionally, automatic accompaniment apparatus of the type mentioned have been realized with electronic musical instruments, for example, of the keyboard type. Some of the automatic accompaniment apparatus detect a chord from performance information inputted by operation of the keyboard and produces chord component sounds of the chord at a timing in accordance with an accompaniment pattern to perform automatic accompaniment of the chord. The accompaniment pattern can be selected from among a plurality of kinds of accompaniment patterns in accordance with the style of the tune.

By the way, a chord defines the names of sounds to be produced, and the same chord includes a plurality of inversion types in accordance with combinations of the pitches of sounds to be produced. Therefore, when the sounds are to be produced actually, the inversion type must necessarily be determined. To this end, in conventional automatic accompaniment apparatus, a particular inversion type is used fixedly to shift the sound pitches parallelly in response to a chord to produce sounds as seen from FIG. 8.

Referring to FIG. 8, in the example shown, when the chord is "C", the inversion type includes, in order from the lowest pitch, "mi" (mediant) and "so" (dominant) and "do" (tonic) and even when the chord is changed to "F", only the sound pitches are shifted, but the inversion type of the chord includes "la" (mediant), "do" (dominant) and "fa" (tonic) and is the same as that of the chord "C".

However, only a shift of the pitches with the same inversion type sometimes makes the accompaniment unnatural in that such a high jump of fourth or fifth occurs with the highest sound which is most liable to catch the ears among the accompaniment sounds, as at portions a and b in FIG. 8.

SUMMARY OF THE INVENTION

It is an object of the present invention to provide an automatic accompaniment apparatus which performs automatic accompaniment in a natural feeling in accordance with the advancement of chords.

In order to attain the object described above, according to the present invention, there is provided an automatic accompaniment apparatus wherein that one of component sounds of a chord which has a particular position in order of the pitch is set as a noticeable part sound and the inversion type of the chord is determined from the noticeable part sound, and then sounds of the chord are produced in accordance with the inversion type thus determined, which comprises noticeable part sound determination means for determining, as production of sounds of chords proceeds, a noticeable part sound of a present chord in accordance with a musical interval relationship of component sounds of the present chord to another noticeable part sound of a preceding chord and a preset rule, and inversion type determination means for determining the inversion type of the present chord with reference to the noticeable part sound.

Preferably, the noticeable part sound determination means has a plurality of preset rules, and the automatic accompaniment apparatus further comprises means for designating one of the preset rules which is to be used for determination of a noticeable part sound of a present chord.

In the automatic accompaniment apparatus, a noticeable part sound is a sound which is set in advance as a reference for determination of an inversion type of a chord from that one of component sounds of the chord which has a predetermined position in order of the pitch such as, for example, a highest sound, a lowest sound or an intermediate sound of the chord. Then, the pitch of the noticeable part sound of the chord produced once is stored. Then, the noticeable part sound of a present chord is determined in accordance with a musical interval relationship of component sounds of the present chord to the thus stored pitch of the noticeable part sound of the preceding chord and the preset rule, that is, a musical interval condition having a predetermined priority order. Then, the inversion type of the present chord is determined with reference to the noticeable part sound thus determined.

Accordingly, as production of chords proceeds, the tendency in which the musical interval relationship between noticeable part sounds of adjacent chords satisfies the predetermined musical interval relationship of a high priority order becomes high, and consequently, accompaniment sounds produced give a natural feeling. Further, where it is made possible to select a noticeable part sound so that the degree of connection of accompaniment can be selected in accordance with, for example, a style of a tune, more natural accompaniment can be obtained.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
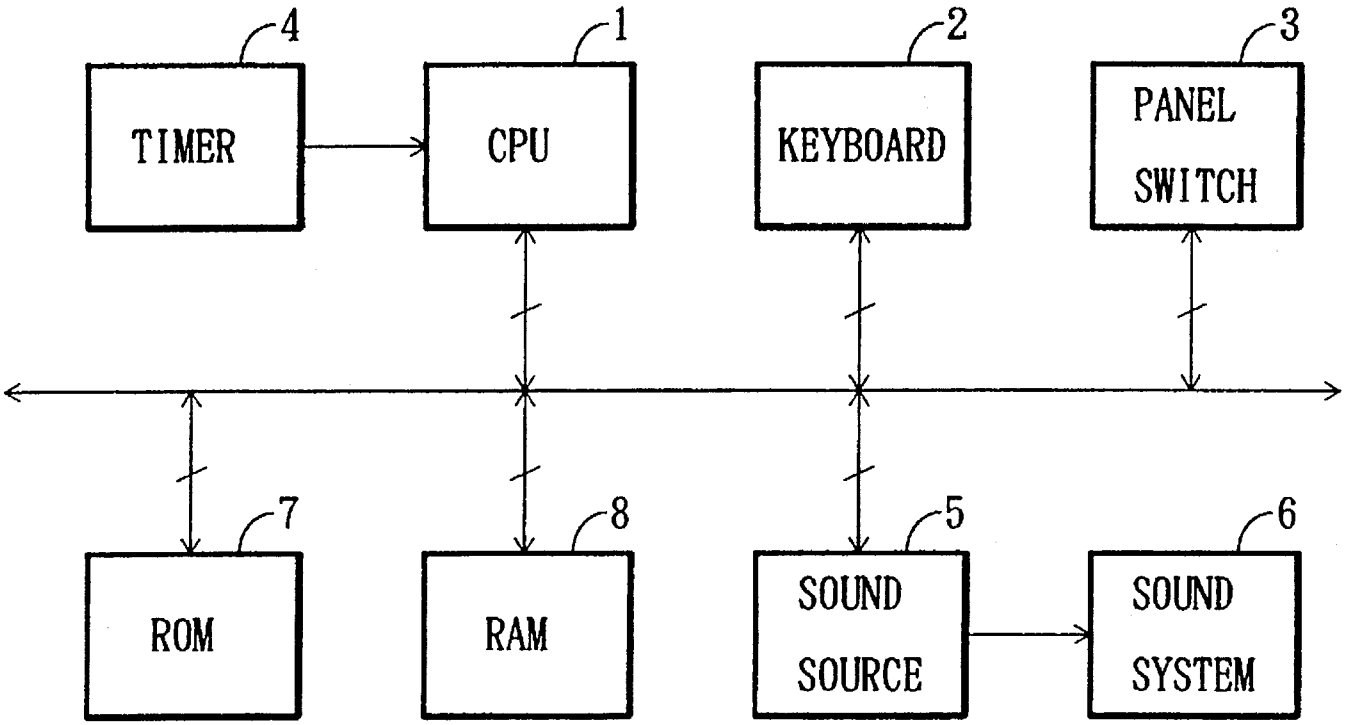
FIG. 1 is a block diagram of an electronic musical instrument in which an automatic accompaniment apparatus according to the present invention is incorporated.

Referring first to FIG. 1, there is shown an electronic musical instrument in which an automatic accompaniment apparatus according to the present invention is incorporated. The electronic musical instrument shown includes a CPU (central processing unit) 1 for controlling the entire electronic musical instrument, and a keyboard 2 and a panel switch unit 3 for manual operation. In response to manual operation of the keyboard 2 and the panel switch unit 3, the electronic musical instrument performs a keyboard performance in an ordinary mode or a keyboard performance and automatic accompaniment in an automatic accompaniment mode. Further, upon automatic accompaniment, chords are detected from the keyboard 2, and the first chord is produced in a predetermined inversion type, but the inversion type of each of the following chords is determined based on a musical interval condition between component sounds of the chord and a noticeable part sound which is the highest sound or the lowest sound of the preceding chord produced precedently, and then sounds of the inversion type are produced. It is to be noted that the setting of a noticeable part sound and the musical interval condition can be selected in a condition input mode.

When a key event of the keyboard 2 in FIG. 1 which is depression or release of a key occurs, the keyboard 2 outputs a key code corresponding to the key with which the key event has occurred and a key-on signal representative of depression or release of the key. The key code and the key-on signal are fetched into the CPU 1. It is to be noted that the keyboard 2 is divided into a right key area and a left key area in terms of functions in accordance with key codes, and in the automatic accompaniment mode, the keys in the right key area function as keys for a performance of the melody while the keys in the left key area function as keys for detection of a chord.

The panel switch unit 3 includes various switches including a plurality of style selection switches for selecting a style of automatic accompaniment in response to a tune to be played, a start/stop switch for controlling starting or stopping of automatic accompaniment, an entry switch for performing setting of a noticeable part sound or setting of a condition, switches for setting tones and so forth and a power source switch, and outputs a signal in response to an operation event of any switch. The output signal of the panel switch unit 3 is fetched into the CPU 1.

A timer 4 generates a tempo clock for each half beat (for one eighth note) at a timing in accordance with a tempo value set by the CPU 1, and the CPU 1 executes interrupt processing in response to each such tempo clock to perform sound production control of automatic accompaniment.

A sound source 5 has a plurality of sound production channels and includes a normal tone generator (TG) for generating an ordinary musical sound in response to depression of a key, an accompaniment tone generator (TG) for generating a chord of automatic accompaniment and a rhythm tone generator (TG) for generating a rhythm sound. A sound system 6 constituted from an amplifier, loudspeakers and so forth is connected to the sound source 5, and in response to a key-on signal and a key code from the CPU 1, the sound source 5 performs ordinary sound generation/sound turning out processing and generates accompaniment sounds of a chord and a rhythm sound upon automatic accompaniment. It is to be noted that, in the present embodiment, musical sound signals from the accompaniment tone generator and the rhythm tone generator are diminished naturally.

A ROM 7 stores a control program, whose flow charts are shown in FIGS. 4 to 7, accompaniment timing patterns for automatic accompaniment, rhythm patterns and so forth in advance therein, and as hereinafter described, the CPU 1 executes its control based on the control program of the ROM 7 using various registers and flags set in a RAM 8.

Figure 3:
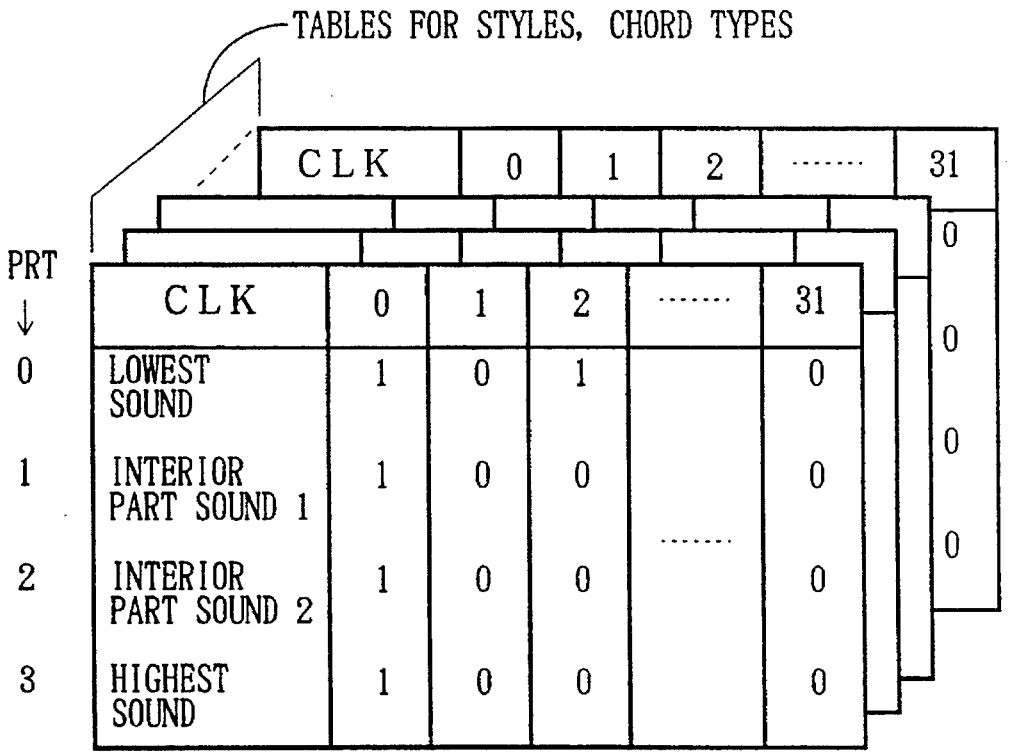
FIG. 3 is a diagrammatic view showing an example of an accompaniment timing pattern employed in the electronic musical instrument of FIG. 1.

FIG. 3 illustrates one of the accompaniment timing patterns stored in the ROM 7. The accompaniment pattern shown is a table in which data of "1/0" which represent sound generation/no sound generation for four chord component sounds of an inversion type of a chord including a lowest sound, an interior part sound 1, an interior part sound 2 and a highest sound are listed corresponding to 32 tempo clocks CLK (CLK=0 to 31) for four bars. Such accompaniment timing pattern is provided for each title, each kind of a chord (major, miner, diminish, 7th and so forth).

Upon automatic accompaniment, inversion types of chords are stored in accordances with the pitches (key codes) of component sounds of the chords in order of the pitch as hereinafter described, and that one of the accompaniment timing patterns which corresponds to the style selected at present and the kind of the detected chord is referred to, and consequently, sounds of the pitches of the component sounds of the chord which exhibit the value 1 in terms of the value of the tempo clock at present (the position in four bars in the resolution of an eighth note) are produced. It is to be noted that the accompaniment timing pattern may otherwise be set freely to the RAM 8.

Here, the method of determining the inversion type of a chord in the present embodiment will be described. First, the noticeable part sound of a chord can be set to either one of the highest sound and the lowest sound of the code. Further, the first chord is set to a predetermined inversion type, and the pitch (key code) of the noticeable part sound in the inversion type is determined. Thereafter, when a chord is detected, it is discriminated which musical interval relationship component sounds of the detected chord have to the noticeable part sound of a preceding chord.

In this instance, two conditions are involved including a first condition (which will be hereinafter referred to as priority order condition) that, giving the highest priority to the condition of a descent of miner second relative to the noticeable part sound, the priority order is determined so that the musical interval difference may be minimum in the order of "a descent of minor second>an ascent of minor second>an equal pitch>a descent of major second>a lower sound, and a second condition (hereinafter referred to as minimum musical interval condition) that, when there are two sounds which present a minimum musical interval difference, a higher one of the two sounds is selected." One of the two conditions can be selected in the condition input mode.

Then, that one of the component sounds of the detected chord which satisfies a predetermined condition for the condition selected at present is determined as the noticeable part sound of the present chord, and the inversion type of the present chord is determined with reference to the noticeable part sound thus determined. For example, when the priority order condition is selected, that one of the component sounds of the present chord which exhibits the highest priority order of the condition satisfied by the musical interval relationship thereof to the noticeable part sound of the preceding chord is set as the noticeable part sound of the present chord. On the other hand, when the minimum musical interval condition is selected, that one of the component sounds of the present chord which presents a minimum musical interval from the noticeable part sound of the preceding chord is set, and when two such component sounds exist, a higher one of the two component sounds is set, as the noticeable part sound of the present chord. However, such an inversion type as comes out of a predetermined compass (for example, C1 to C3) is excepted.

Subsequently, operation of the electronic musical instrument in the present embodiment will be described with reference to FIGS. 4 to 7. It is to be noted that various registers and flags used for control in the following description and the flow charts of FIGS. 4 to 7 are represented by the following labels and contents of the registers and the flags are represented by the same latches unless otherwise specified.

RUN: run flag representative of starting/stopping of automatic accompaniment

Figure 4:
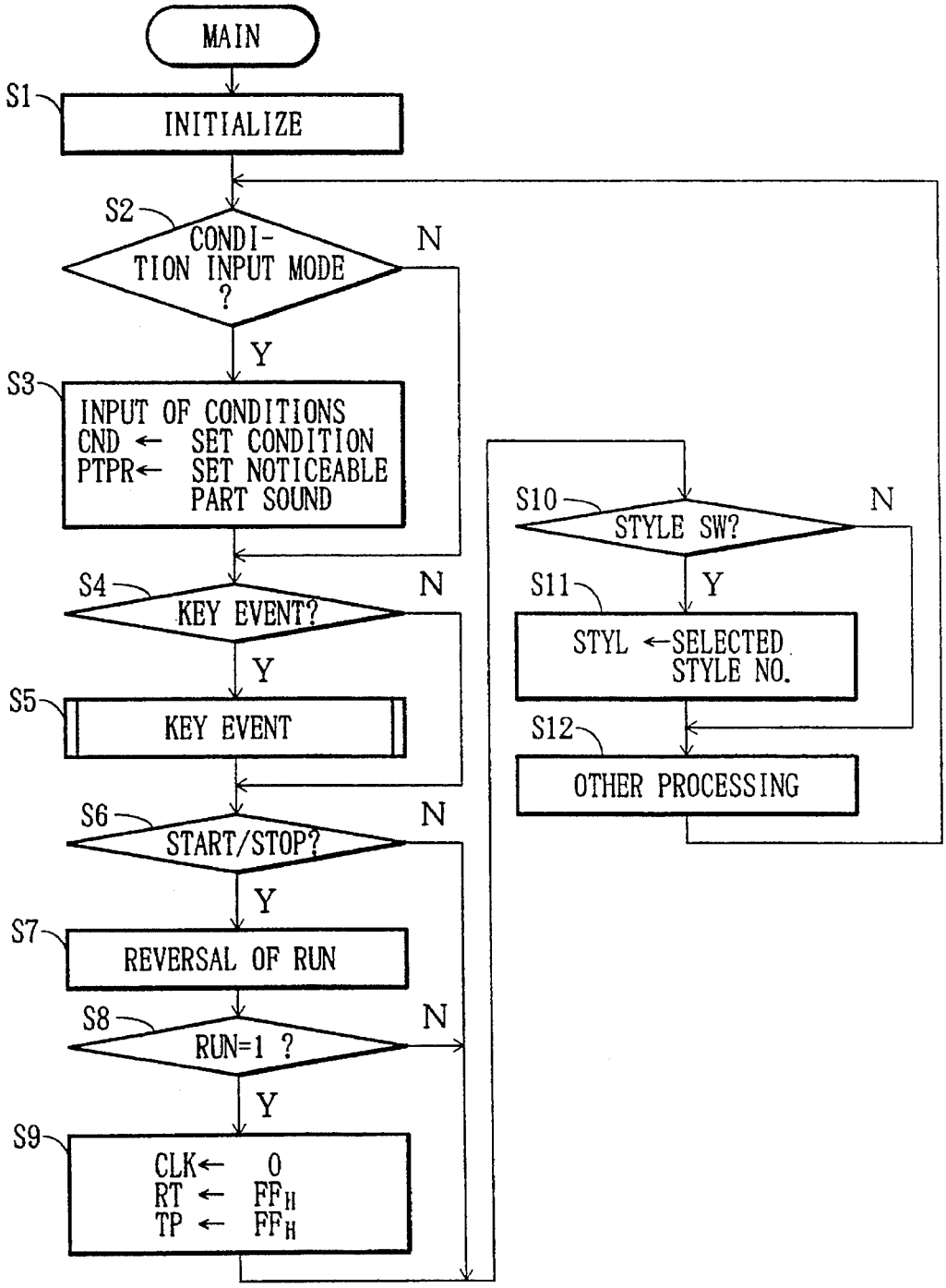
FIG. 4 is a flow chart of a main routine illustrating operation of the electronic musical instrument of FIG. 1.

CND: flag representative of a set one of the priority order condition and the minimum musical interval condition PTPR: flag representative of the type of a noticeable part sound set from a highest sound or a lowest sound STYL: register for storing a selected style number CLK: tempo clock register RT: register for storing a root code of a present chord TP: register for storing a type code of a present chord OLDRT: register in which a root code of a preceding chord is stored OLDTP: register in which a type code of a preceding chord is stored CNSKC(i): register in which key codes of the pitches of component sounds of a chord corresponding to a determined inversion type are stored in order of the pitch corresponding to the variable i N: register in which the pitch number of component sounds of a chord is stored PRT: variable register for scanning key codes of the pitches of component sounds of a chord First, when the power is turned on, the CPU 1 starts processing of the main routine of FIG. 4. Thus, at step S1, the CPU 1 executes initialization including resetting of the run flag RUN, set-up of the registers and so forth. Then at step S2, the CPU 1 discriminates from the state of the panel switch unit 3 whether or not the electronic musical instrument is in the condition input mode at present. If the electronic musical instrument is not in the condition input mode, the control sequence advances to step S4, but on the contrary if the electronic musical instrument is in the condition input mode, then the control sequence advances to step S4 after condition input processing is performed at step S3. The condition inputting processing at step S3 is processing for setting the flags CND and PTPR in response to operation of the panel switch unit 3, and when the priority order condition is selected, the flag CND is set to CND=0, but on the contrary when the minimum musical interval condition is selected, the flag CND is set to CND=1; and when a highest sound is selected as the noticeable part sound, the flag PTPR is set to PTPR=0, but on the contrary when a lowest sound is selected as the noticeable part sound, the flag PTPR is set to PTPR.

Figure 5:
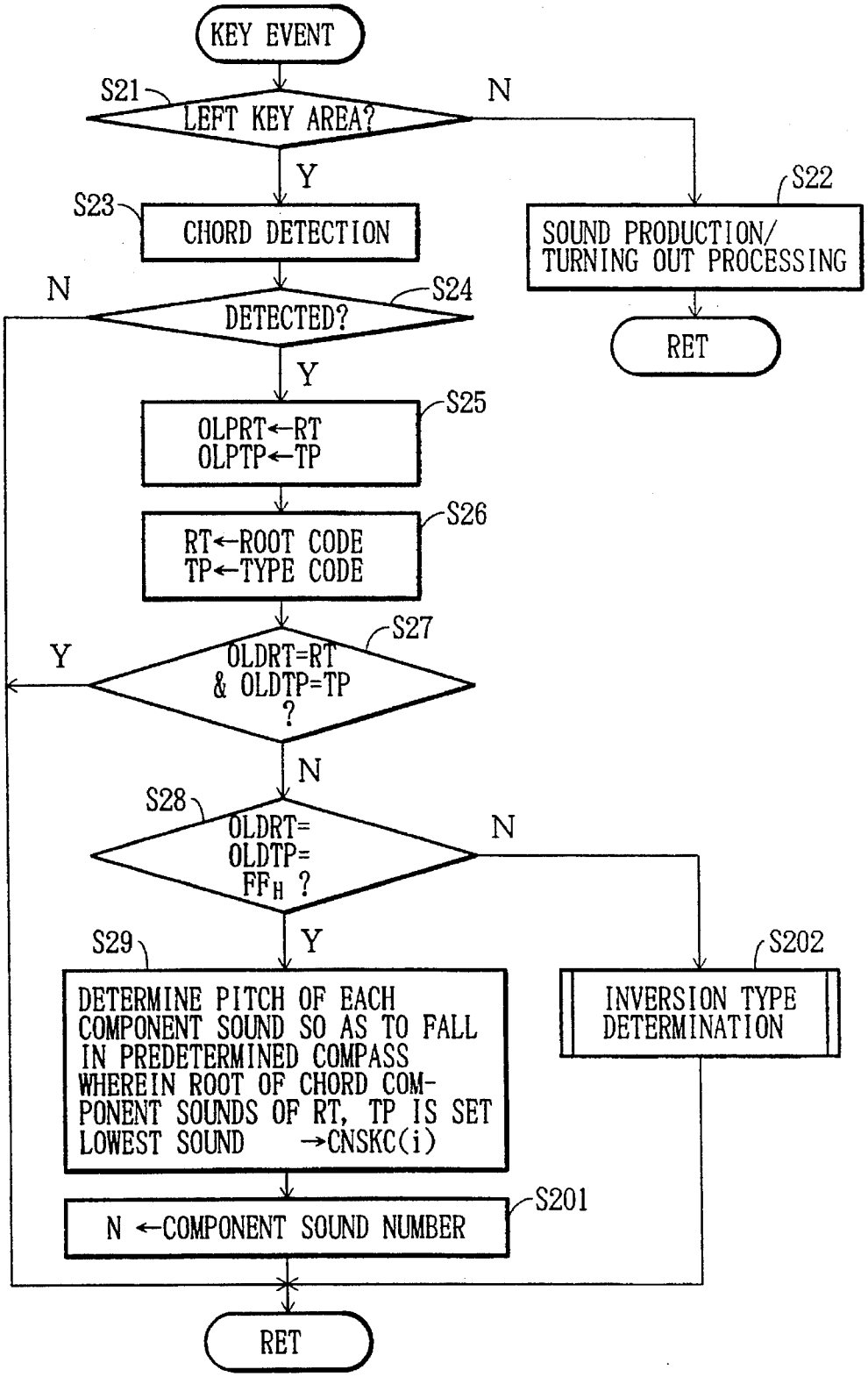
FIG. 5 is a flow chart of a subroutine of key event processing in the main routine of FIG. 4.

At step S4, presence or absence of a key event at the keyboard 2 is discriminated, and if no key event is discriminated, then the control sequence advances to step S6, but on the contrary if there is a key event, then the control sequence advances to step S6 after key event processing illustrated in FIG. 5 is performed at step S5. At step S6, presence or absence of an on-event of the starting/stopping switch of the panel switch unit 3 is discriminated, and if no on-event is discriminated then the control sequence advances to step S10, but on the contrary if an on-event is discriminated, then the CPU 1 executes processing beginning with step S7.

In particular, first at step S7, the flag RUN is reversed, and then at step S8, it is discriminated whether or not RUN=1. If not RUN =1, then since this means that stopping of automatic accompaniment has been designated, the control sequence advances to step S10. On the contrary if RUN=1 is discriminated, then since this means that starting of automatic accompaniment has been designated, the clock register CLK is reset and "$FF_H$" (the suffix "$_H$" denotes a hexadecimal notation) as a default value is placed into the registers RT and TP at step S9 to effect initialization for starting of automatic accompaniment.

Then at step S10 presence or absence of an onevent of the style selection switch of the panel switch unit 3 is discriminated, and if an on-event is discriminated, a style number selected at step S11 is placed into the register STYL, whereafter the control sequence advances to step S12. On the contrary if no on-event is discriminated at step S10, then the control sequence advances directly to step S12. At step S12, some other necessary processing is performed, and then, the control sequence returns to step S2.

Referring now to FIG. 5, there are illustrated details of the key event processing at step S5 of the main routine of FIG. 4 described above. In particular, first at step S21, it is discriminated whether or not the key event at present is a key event in the left key area, and if the key event is not a key event in the left key area since this means that the key event is a key event in the right key area, ordinary sound production/turning out processing is executed at step S22, whereafter the control sequence returns to the main is a key event in the left key area, then chord detection processing is executed at step S23. It is to be noted that the chord detection processing can be achieved using any of such known methods as a fingered method wherein a chord is detected from a combination of keys depressed actually and a single finger method wherein a chord is provided to a simplified depressed key pattern.

After completion of the chord detection processing at step S23, it is discriminated at step S24 whether or not a chord has been detected, and if no chord has been detected, the control returns directly to the main routine, but on the contrary if a chord has been detected, then the contents of the registers RT and TP are saved into the registers OLDRT and OLDTP. Respectively, at step S25. Then at step S26, a root code of the chord detected at present is placed into the register RT and a type code is placed into the register TP, whereafter the control sequence advances to step S27.

At step S27, it is discriminated whether or not the two conditions of OLDRT=RT and OLDTP=TP are satisfied, and if the conditions are satisfied, then since this means that the chord detected at present is the same as the preceding chord, the control sequence returns directly to the main routine. But on the contrary if the conditions are not met at step S27, then since this means that the chord detected at present is different from the preceding chord, processing at step S28 is executed subsequently. In particular, at step S28, it is discriminated whether or not the conditions of OLDRT=$FF_H$ and OLDTP=$FF_H$ are satisfied. If the conditions are satisfied, then the CPU 1 executes processing beginning with step S29, but on the contrary if the conditions are not satisfied, then the CPU 1 executes inversion type determination processing of FIG. 6 at step S202. Whereafter the control sequence returns to the main routine.

The discrimination at step S27 discriminates whether or not the chord detected at present is a chord detected first after starting of automatic accompaniment, and the condition at step S28 is satisfied if the detection of the chord at present is the first detection as a result of the processing at step S9 (FIG. 4) and step S25. If the condition at step S28 is satisfied, then at step S29, the pitches of individual component sounds of the detected chord, that is, a chord corresponding to the root code in the register RT and the type code in the register TP, are determined so that they may be included in a predetermined compass wherein the root sound of the chord component sounds is the lowest sound, and the key codes of them are successively stored into the registers CNSKC(0), CNSKC(1), CNSKC(2), . . . in reverse order of the pitch beginning with the lowest one. Then at step S201, the number of the component sounds is placed into the register N, whereafter the control sequence returns to the main routine.

As a result of the processing described above, the inversion type of the first chord is set, and the key codes of it are stored in the registers CNSKC(i) (i=0 to N−1). It is to be noted that the condition at step S28 is no more satisfied upon detection of a second or following chord after the first chord, and consequently, inversion type determination processing at step S202 will be executed.

Figure 6:
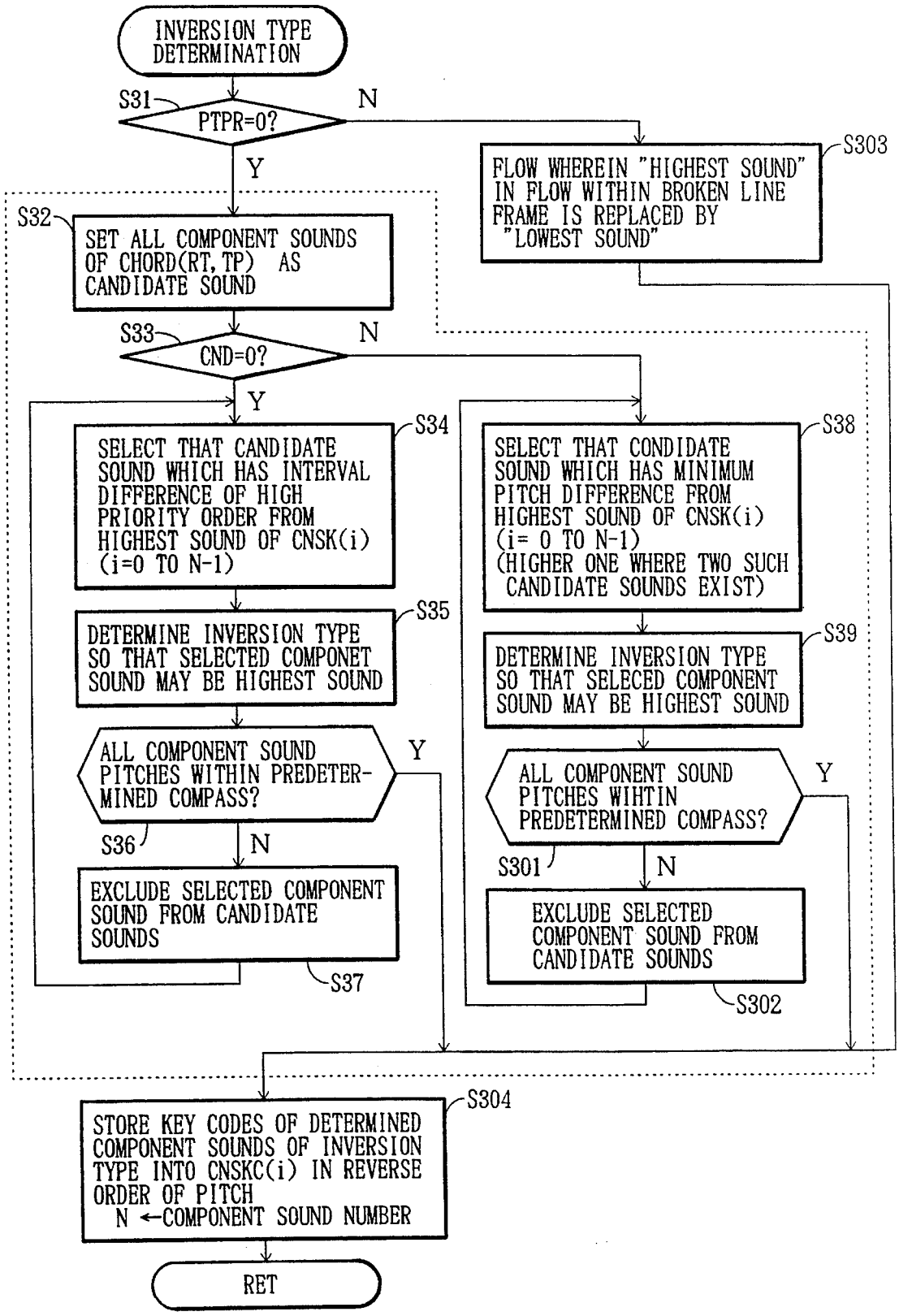
FIG. 6 is a flow chart of a subroutine of inversion type determination processing in the key event processing subroutine of FIG. 5.

Details of the inversion type determination processing at step S202 are illustrated in FIG. 6. Referring to FIG. 6, it is discriminated first at step S31 whether or not the register PTPR is PTPR=0. In particular, this is processing of discriminating whether or not the noticeable part sound is set to a highest sound, and if PTPR=0, then processing for a case wherein a highest sound is set to the noticeable part sound is executed at steps beginning with step S32, but if not PTPR=0, then processing for another case wherein a lowest sound is set to the noticeable part sound is executed at step S303. It is to be noted that details of the processing at step S303 are omitted herein since they are simple as hereinafter described.

When a highest sound is set to the noticeable part sound, all of the component sounds of the detected chord (chord designated by RT and TP) are set as candidate sounds at step S32, and then it is discriminated at step S33 whether or not the flag CND is CND=0. In particular, this is processing for discriminating whether the priority order condition is selected or the minimum musical interval condition is selected, and if CND=0, then since the priority order condition is selected, processing at steps beginning with step S34 is executed, but if not CND=0, then since the minimum musical interval condition is selected, processing at steps beginning with step S38 is executed.

At step S34, all of the candidate sounds at present are compared with the highest one of the sounds in the CNSKC(i) (i=0 to N−1) of the preceding chord (that is, the noticeable part sound of the preceding chord) to select, as the noticeable part sound of the present chord, that one of the candidate component sounds which exhibits a greatest musical interval difference from the highest sound of the preceding chord and hence a highest priority order in the priority order condition. Then at step S35, the inversion type of the chord is determined so that the selected component sound may be a highest sound. Subsequently at step S36, it is determined whether or not all of the pitches of the component sounds of the thus determined inversion type are included in a predetermined compass (for example, within C1 to C3), and if the pitches are included in the predetermined compass, then the control sequence advances to step S304, but on the contrary if the pitches are not included in the predetermined compass, then the processing beginning with step S34 is repeated after the component sound selected as the noticeable part sound at present is excluded from the candidate sounds at step S37.

As a result of the processing described above, the inversion type of the chord determined finally is included in the predetermined compass, and the musical interval difference between the highest sound of the preceding chord and the highest sound of the present chord is an appropriate musical interval difference based on the priority order condition.

On the other hand, when the minimum musical difference condition is discriminated at step S33, all of the candidate sounds of the present chord are compared, at step S38, with the highest one of the sounds in the CNSKC(i) (i=0 to N−1) of the preceding chord (that is, the noticeable part sound of the preceding chord) to select, as a noticeable part sound of the present chord, that one of the candidate sounds which presents a smallest musical interval difference from the highest sound of the preceding chord. It is to be noted that, when there are two such candidate sounds, that one of the sounds which has a higher pitch is selected. Then at step S39, the inversion type of the chord is determined so that the selected component sound may be a highest sound, and then at step S301, it is discriminated whether or not all of the pitches of the component sounds of the thus determined inversion type are included in a predetermined compass (for example, within C1 to C3). If the pitches are included in the predetermined compass, then the control sequence advances to step S304, but on the contrary if the pitches are not included in the predetermined compass, then the processing beginning with step S38 is repeated after the component sound selected as the noticeable part sound at present is excluded from the candidate sounds at step S302.

As a result of the processing described above, the inversion type of the chord is included in the predetermined compass, and the musical interval difference between the highest sound of the preceding chord and the highest sound of the present chord is a minimum one.

At step S304, the key codes of the component sounds of the inversion type determined finally are stored into the registers CNSKC(i) in reverse order of the pitch beginning with the lowest one (in order of CNSKC(0), CNSKC(1), . . .), and then the number of the component sounds is placed into the register N, whereafter the control sequence returns to the main routine. It is to be noted that the key codes in the registers CNSKC(i) are outputted to the sound source 8 in interrupt processing of FIG. 7 so that sounds of them are produced with the pitches of the determined inversion type.

It is to be noted that when a lowest sound is set as a noticeable sound, the control sequence advances from step S31 to step S303, and in this instance, at step S303, processing similar to that with regard to the highest sound of the preceding chord when the highest sound is set as a noticeable part sound as described above is executed with regard to the lowest sound of the preceding chord set as the noticeable part sound. In other words, the processing at step S303 corresponds to the processing at those steps of the flow chart of FIG. 6 which are surrounded by a broken line frame and in which every "highest sound" is replaced by "lowest sound". Therefore, details of the processing at step S303 are omitted for simplified illustration and description.

Figure 7:
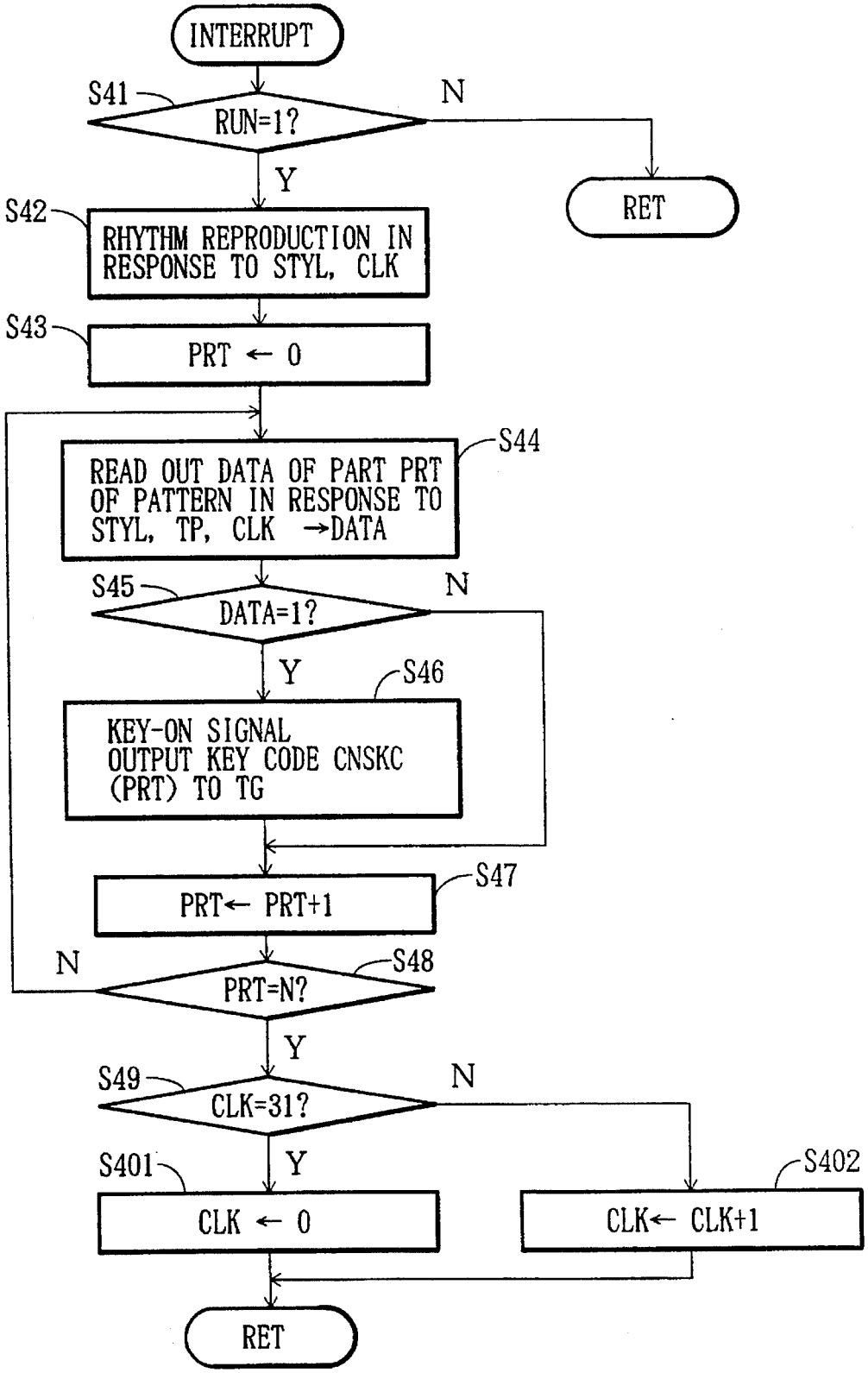
FIG. 7 is a flow chart of interrupt processing illustrating operation of the electronic musical instrument of FIG. 1.

Referring now to FIG. 7, there is shown a subroutine of interrupt processing of the CPU 1 of the electronic musical instrument. The interrupt processing is started after each half beat (for one eighth note) in response to a tempo clock from the timer 4, and first at step S41, it is discriminated whether or not the flag RUN is RUN=1. If not RUN=1, then the control sequence returns to the original routine, but on the contrary if RUN=1, then since this means that the electronic musical instrument is in an automatic accompaniment advancing condition, reproduction of the rhythm is performed in response to the rhythm pattern selected in the register STYL and the register CLK at step S42, whereafter the variable register PRT is reset at step S43.

Then at step S44, data ("0" or "1") corresponding to the register CLK at present and corresponding to the component sound indicated by the variable register PRT (refer to FIG. 3) are read out referring to that one of the accompaniment timing patterns which corresponds to the registers STYL and TP and are placed into the register DATA. Subsequently at step S45, it is discriminated whether or not the register DATA is DATA=1, and if not DATA=1, then since the component sound of the register PRT should not be produced, the control sequence advances to step S46, at which a key-on signal and key-codes of the register CNSKC(PRT) are outputted to the sound source 8 so as to produce musical sounds of automatic accompaniment.

Then at step S47, the variable register PRT is incremented, and then at step S48, it is discriminated whether or not the variable register PRT is PRT=N. If not PRT=N, since this means that some key code whose sound has not been produced as yet is present in the registers CNSKC(i), the processing beginning with step S44 is repeated. But on the contrary if PRT=N, then since this means that sounds of all key codes of the registers CNSKC(i) have been produced, processing of the clock CLK is executed at steps beginning with step S49. In particular, at step S49, it is discriminated whether or not the clock CLK is CLK=31, and if the clock CLK reaches 31, then, the clock CLK is reset at step S401. Whereafter the control sequence returns to the original routine. But if the clock CLK does not reach 31 as yet, then the clock CLK is incremented at step S402, whereafter the control sequence returns to the original routine.

While, in the embodiment described above, the inversion type of a first chord is determined with a lowest sound set as the root, the condition is not limited to this, and the inversion type of a first chord may otherwise be set in accordance with some other condition, for example, with a highest sound set as the root.

Figure 2:
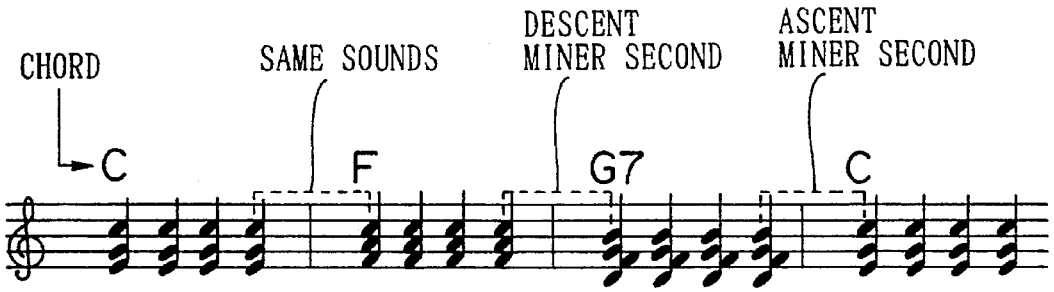
FIG. 2 is a diagram illustrating an example of production of automatic accompaniment sounds by the electronic musical instrument of FIG. 1.

FIG. 2 illustrates an example of production of sounds of automatic accompaniment when a highest sound is set as the noticeable part sound and the priority order condition is selected in the embodiment described above and shows a case wherein the inversion type of the first chord "C" is determined with "do" set as the highest sound. When production of sounds advances from the first chord "C" to a next chord "F", that one of component sounds of the chord "F" which satisfies a highest priority condition in the priority order condition with respect to the noticeable part sound "do" of the chord "C" is the sound "do" (condition of the equal sound), and the inversion type of the chord "F" is determined with this "do" set as the noticeable part sound.

Similarly, as regards a further next chord "G7". "si" is set as the noticeable part sound in the condition of "descent minor second" in advancement from "do" of the chord "F" to "si" of the chord "G7"; as regards a succeeding chord "C". "do" is set as the noticeable part sound in the condition of "ascent minor second" in advancement from "si" of the chord "G7" to "do" of the chord "C", and each of the inversion types of the chords "G7" and "C" is determined in the respective setting condition.

Figure 8:
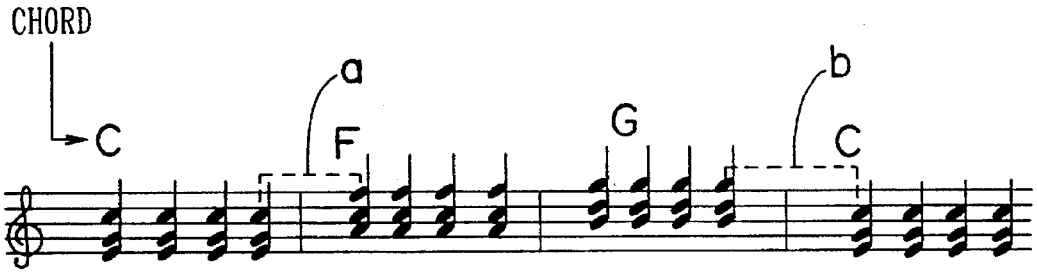
FIG. 8 PRIOR ART
FIG. 8 is a diagram illustrating an example of conventional production of automatic accompaniment sounds.

In this manner, since the musical interval difference between noticeable part sounds upon transition of chords is selected appropriate in accordance with the priority order condition, such a disadvantage that a jump of sounds occurs as has been described hereinabove with reference to FIG. 8 can be prevented.

While a highest sound of a lowest sound is set as the noticeable part sound in the embodiment described above, the noticeable part sound is not limited to any of them, and an intermediate sound may alternatively be set as the noticeable part sound. Further, the method of controlling production of sounds for automatic accompaniment is not limited to the specific method wherein such production of sounds is controlled using accompaniment timing patterns as in the present embodiment, and some other method may be employed instead.

Having now fully described the invention, it will be apparent to one of ordinary skill in the art that many changes and modifications can be made thereto without departing from the spirit and scope of the invention as set forth herein.

What is claimed is:

1. An automatic accompaniment apparatus wherein one of a plurality of component sounds of a chord which has a particular position in order of pitch is set as a reference part sound and an inversion type of the chord is determined from the reference part sound, and then sounds of the chord are produced in accordance with the inversion type thus determined, comprising:

reference part sound determination means for determining, as a production of sounds of chords proceeds, a reference part sound of a present chord in accordance with a musical interval relationship between component sounds of the present chord and a reference part sound of a preceding chord and further in accordance with a preset rule; and inversion type determination means for determining an inversion type of the present chord based on the reference part sound of the present chord.

2. An automatic accompaniment apparatus as claimed in claim 1, wherein said reference part sound determination means includes a plurality of preset rules, and further includes means for designating one of the plurality of preset rules to be used for determination of the reference part sound of the present chord.

3. An automatic accompaniment apparatus as claimed in claim 1, wherein the reference part sound of the present chord is the highest pitch component sound of the present chord.

4. An automatic accompaniment apparatus as claimed in claim 1, wherein the reference part sound of the present chord is the lowest pitch component sound of the present chord.

5. An automatic accompaniment apparatus as claimed in claim 1, wherein the reference part sound of the present chord is an intermediate pitch component sound of the present chord.

6. A method of determining an inversion type in an automatic accompaniment device, the method comprising the steps of:

detecting a plurality of component sounds forming a present chord;

prioritizing an amount of interval difference between each of the plurality of component sounds forming the present chord and a reference part sound of a preceding chord from lowest to highest priority in accordance with a preset rule;

selecting the highest priority amount of interval difference between one of the plurality of component sounds and the reference part sound of the preceding chord;

setting said one of the plurality of component sounds as a reference part sound of the present chord; and determining an inversion type of the present chord based upon the reference part sound of the present chord.

7. A method according to claim 6, further including the step of determining if all component sounds of the determined inversion type are within a predetermined compass.

8. A method according to claim 7, further including the steps of:

excluding the one component sound, corresponding to the reference part sound of the present chord, from the prioritizing step when all of the component sounds of the determined inversion type are not within the predetermined compass; and repeating the steps of prioritizing, selecting, setting, determining the inversion type, and determining if all of the component sounds are within the predetermined compass until all of the component sounds for the determined inversion type are within the predetermined compass.

9. A method according to claim 6, wherein the highest priority amount of interval difference is selected on the basis of a minimum interval.

10. A method according to claim 6, wherein the highest priority of interval difference is selected on the basis of a maximum interval between the plurality of component sounds and a highest note of the preceding chord.

11. A method of determining an inversion type in an automatic accompaniment device, the method comprising the steps of:

detecting a plurality of component sounds forming a present chord;

selecting a minimum interval difference between one of the plurality of component sounds and a reference part sound of a preceding chord;

setting the one of the plurality of component sounds as the reference part sound of the present chord; and determining an inversion type of the present chord based upon the reference part sound of the present chord.

12. A method according to claim 11, further including the step of determining if all component sounds of the determined inversion type are within a predetermined compass.

13. A method according to claim 12, further including the steps of:

excluding the one component sound, corresponding to the reference part of the present chord, from the selecting step when all of the component sounds of the determined inversion type are not within the predetermined compass; and repeating the steps of selecting, setting, determining the inversion type, and determining if all of the component sounds are within the predetermined compass until all of the component sounds for the determined inversion type are within the predetermined compass.

14. A method according to claim 11, wherein when two of the plurality of component sounds each have the same minimum amount of interval difference then one of the two component sounds is selected in accordance with a preset rule.

15. A method according to claim 14, wherein the preset rule causes the one component sound having a highest pitch to be selected as the one component sound having the minimum amount of interval difference.

* * * * *